US009202436B2

(12) United States Patent
Nakamizo et al.

(10) Patent No.: US 9,202,436 B2
(45) Date of Patent: Dec. 1, 2015

(54) DISPLAY DEVICE WITH AUXILIARY CAPACITANCE LINE

(75) Inventors: Masahiko Nakamizo, Osaka (JP); Fumikazu Shimoshikiryoh, Osaka (JP); Takamitsu Suzuki, Osaka (JP); Akifumi Hashimoto, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 151 days.

(21) Appl. No.: 13/880,384

(22) PCT Filed: Oct. 26, 2011

(86) PCT No.: PCT/JP2011/074607

§ 371 (c)(1),
(2), (4) Date: Apr. 19, 2013

(87) PCT Pub. No.: WO2012/060254

PCT Pub. Date: May 10, 2012

(65) Prior Publication Data

US 2013/0207884 A1 Aug. 15, 2013

(30) Foreign Application Priority Data

Nov. 2, 2010 (JP) ..... 2010-246478

(51) Int. Cl.
*G09G 3/36* (2006.01)
*G09G 5/10* (2006.01)

(52) U.S. Cl.
CPC ..... *G09G 5/10* (2013.01); *G09G 3/3659* (2013.01); *G09G 2320/0233* (2013.01)

(58) Field of Classification Search
CPC ..... G09G 3/34; G09G 3/36; G09G 3/30; G02F 1/1345
USPC ..... 345/84, 88, 92, 94, 98; 349/152
See application file for complete search history.

(56) References Cited

U.S. PATENT DOCUMENTS

2003/0234904 A1* 12/2003 Matsuda et al. ..... 349/152
2006/0221023 A1* 10/2006 Inoue et al. ..... 345/87
2010/0245305 A1* 9/2010 Yokoyama et al. ..... 345/205
2011/0050759 A1* 3/2011 Katsutani et al. ..... 345/694

FOREIGN PATENT DOCUMENTS

JP 2009-128533 A 6/2009
JP 2009-145470 A 7/2009

OTHER PUBLICATIONS

Official Communication issued in International Patent Application No. PCT/JP2011/074607, mailed on Dec. 13, 2011.

* cited by examiner

*Primary Examiner* — Pegeman Karimi
(74) *Attorney, Agent, or Firm* — Keating & Bennett, LLP

(57) ABSTRACT

A display device 10 according to the present invention includes a plurality of pixels 40 each including a plurality of sub pixels 42, a plurality of auxiliary capacitance lines 36 forming an auxiliary capacitance 56 with the sub pixels 42, and an auxiliary capacitance driver 34 configured to supply an auxiliary capacitance drive signal to the auxiliary capacitance lines 36 and to apply a voltage to the auxiliary capacitance. In the display device 10, the auxiliary capacitance driver 34 includes a plurality of connection terminals 64 each connected to each of the auxiliary capacitance lines 36.

1 Claim, 11 Drawing Sheets

DISPLAY DEVICE WITH AUXILIARY CAPACITANCE LINE

TECHNICAL FIELD

The present invention relates to a display device including a plurality of pixels, in particular to a display device including an auxiliary capacitance line that forms an auxiliary capacitance with the pixels.

BACKGROUND ART

In recent years, high-performance display devices such as a large screen television have been widely used. In such a display device, unevenness in a displayed image may largely deteriorate an image quality. Thus, correction of the unevenness is required. The unevenness includes brightness unevenness that may be caused by display brightness varied for each pixel and color unevenness that may be caused by chromaticity difference. In addition to such unevenness, problems of unevenness caused by a dependence of gamma characteristics, which is varied according to a gradation level of the display brightness, on a visual perception are increasing.

Patent Documents 1 and 2 disclose a multi pixel drive method as a technology that can reduce the unevenness caused by the dependence of the gamma characteristics on the visual perception. According to this technology, one pixel is divided into sub pixels and a different auxiliary capacitance drive signal is supplied to a different auxiliary capacitance line that forms an auxiliary capacitance with each of the sub pixels. In the multi pixel drive method, the auxiliary capacitances each corresponding to each sub pixel are separately controlled. Accordingly, the dependence of the gamma characteristics on the visual perception can be independently changed for each sub pixel, and thus the unevenness caused by the dependence of the gamma characteristics on the visual perception can be reduced.

RELATED ART DOCUMENT

Patent Document

Patent Document 1: Japanese Unexamined Patent Publication No. 2009-128533

Patent Document 2: Japanese Unexamined Patent Publication No. 2009-145470

Problem to be Solved by the Invention

However, in the multi pixel drive method according to the conventional technology, only a few kinds of auxiliary capacitance drive signals is supplied to the auxiliary capacitance lines, and thus the auxiliary capacitance drive signals are required to be supplied to a relatively large number of auxiliary capacitance lines included in the display device. This increases a load (wiring resistance and wiring capacitance) on a trunk line that transmits the same kind of auxiliary capacitance drive signals to the auxiliary capacitance lines. Accordingly, a delay may occur in a transmission of the auxiliary capacitance drive signals. Further, the delay may be different for each of the auxiliary capacitance lines. If such problems of the delay in the transmission of the auxiliary capacitance drive signals and the transmission delay difference occur, the auxiliary capacitance corresponding to each sub pixel cannot be properly controlled. Thus, display defects may occur.

The line for supplying the auxiliary capacitance drive signals may have a larger width to reduce the wiring resistance and to reduce the display defects. However, if the line having a larger width is used, a reduction in area of a frame section where no pixel is provided may be difficult.

DISCLOSURE OF THE PRESENT INVENTION

The present invention was accomplished in view of the above circumstances. It is an object of the present invention to provide a technology that can reduce the display defects and the area of the frame section in the display device.

Means for Solving the Problem

To solve the above-described problems, a display device according to the present invention includes a plurality of pixels each including a plurality of sub pixels, a plurality of auxiliary capacitance lines configured to form an auxiliary capacitance with the sub pixels, and an auxiliary capacitance line driver configured to supply an auxiliary capacitance drive signal to the auxiliary capacitance lines and to apply a voltage to the auxiliary capacitance. The auxiliary capacitance line driver includes a plurality of first connection terminals each connected to each of the auxiliary capacitance lines.

In the display device, the auxiliary capacitance lines are separately connected to the auxiliary capacitance line driver such that the auxiliary capacitance drive signal is directly supplied from the auxiliary capacitance line driver to each of the auxiliary capacitance lines. Accordingly, the transmission delay and the transmission delay difference of the auxiliary capacitance drive signals are less likely to occur, thereby reducing the display defects. Further, the display device is not required to include a trunk line for transmitting the auxiliary capacitance drive signal to the auxiliary capacitance lines, and thus such a trunk line is not required to have a larger width to reduce the transmission delay of the auxiliary capacitance. In this configuration, the area of the frame section that is a section other than section in which the pixels are arranged can be reduced.

Each of the auxiliary capacitance lines may form the auxiliary capacitance with each of the sub pixels included in each of the pixels.

The above-described display device can separately control the auxiliary capacitance corresponding to each of the sub pixels included in one pixel. This can provide advantages in displaying such as expansion of a viewing angle due to an improvement in the dependence of the gamma characteristics on the visual perception, for example.

The display device may further include a first trunk line. The auxiliary capacitance line driver may be configured to supply a first auxiliary capacitance drive signal to a first auxiliary capacitance line group including the auxiliary capacitance lines, and the first auxiliary capacitance line group may be connected to the auxiliary capacitance line driver via the first trunk line.

In the above-described display device, the first trunk line synchronizes the first auxiliary capacitance drive signals that are supplied to the first auxiliary capacitance line group. With this configuration, the transmission delay difference of the first auxiliary capacitance drive signals is less likely to occur, thereby improving the display characteristics. The first trunk line is only configured to synchronize the first auxiliary capacitance drive signals and is not configured to transmit the first auxiliary capacitance drive signals. Accordingly, the first trunk line can have a small width compared with the conventional trunk line configured to transmit the auxiliary capacitance drive signals, and thus the area of the frame section can be reduced.

The display device may further include a plurality of scanning lines connected to the pixels, and a scanning line driver configured to supply a scanning line drive signal to the scanning lines to drive the pixels. The scanning lines and the auxiliary capacitance lines may extend in a first direction. The auxiliary capacitance line driver and the scanning line driver may be located adjacent to a first end in the first direction of a section in which the pixels are arranged.

In the above-described display device, in the same frame section, the auxiliary capacitance line driver is connected to the auxiliary capacitance lines and the scanning line driver is connected to the scanning lines. Accordingly, the area of the frame section can be reduced.

The auxiliary capacitance line driver may include two auxiliary capacitance line drivers and the scanning line driver may include two scanning line drivers. Each of the auxiliary capacitance line drivers and each of the scanning line drivers may be located adjacent to each end in the first direction of the section in which the pixels are arranged.

In the above-described display device, the drive signals may be supplied from each end to the auxiliary capacitance lines and the scanning lines. Accordingly, the transmission delay of the drive signals can be reduced.

The auxiliary capacitance line driver and the scanning line driver may be included in a pixel driver.

The above-described display device can share the lines for signals such as a power potential that are supplied to both of the auxiliary capacitance line driver and the scanning line driver. In addition, in the production of the display device, the connection of the auxiliary capacitance line driver and the scanning line driver to the auxiliary capacitance lines and the scanning lines can be facilitated.

The scanning line driver may include a plurality of second connection terminals connected to the scanning lines. The first connection terminals and the second connection terminals may be arranged in a second direction different from the first direction so as to correspond to the auxiliary capacitance lines and the scanning lines, respectively, in the second direction.

In the above-described display device, when the first connection terminals and the second connection terminals are connected to the auxiliary capacitance lines and the scanning lines, respectively, via the lines for example, the auxiliary capacitance lines and the scanning lines are hardly overlapped with each other. Accordingly, the area of the frame section can be reduced.

The display device may further include a connection device, a plurality of first connection lines, and a plurality of second connection lines. The scanning line driver may include a plurality of second connection terminals connected to the scanning lines. The connection device may include a plurality of third connection terminals, fourth connection terminals, fifth connection terminals, and sixth connection terminals therein. The third connection terminals may be connected to the first connection terminals via the first connection lines. The fourth connection terminals may be connected to the second connection terminals via the second connection lines. The fifth connection terminals may be connected to the third connection terminals and the auxiliary capacitance lines. The sixth connection terminal may be connected to the fourth connection terminals and the scanning lines. The third connection terminals and the fourth connection terminals may be arranged in a second direction different from the first direction so as to correspond to the first connection terminals and the second connection terminals, respectively, in the second direction. The fifth connection terminals and the sixth connection terminals may be arranged in the second direction so as to correspond to the auxiliary capacitance lines and the scanning lines, respectively, in the second direction.

In the above-described display device including the connection device, the lines can connect the first connection terminals and the second connection terminals to the third connection terminals and the fourth connection terminals, respectively, without being overlapped with each other. In addition, the lines can connect the fifth connection terminals and the sixth terminals to the auxiliary capacitance lines and the scanning lines, respectively, without being overlapped with each other. Accordingly, the area of the frame section can be reduced.

The display device may further include a plurality of third connection lines, and a plurality of second trunk lines. Each of the first connection terminals may be connected to each of the second trunk lines via each of the third connection lines. Each of the third connection lines may be connected to each of the second trunk lines at a first position of the second trunk line and each of the auxiliary capacitance lines may be connected to each of the second trunk lines at a second position of the second trunk line away from the first position. The second trunk lines may be arranged between the auxiliary capacitance lines and the auxiliary capacitance driver so as to be connected to the auxiliary capacitance lines and the auxiliary capacitance driver.

In the above-described display device, even if the positions of the first connection terminals do not to correspond to the positions of the auxiliary capacitance lines, the third lines can be used to change the arrangement order of one of the first connection terminals and the auxiliary capacitance lines by use of the difference between the first positions and the second positions. This facilitates the connection of the first connection terminals and the auxiliary capacitances.

The display device according to the present technology is not limited to the display device including the auxiliary capacitance lines separately connected to the auxiliary capacitance line driver. For example, auxiliary capacitance line groups each including a predetermined number of auxiliary capacitance lines may be separately connected to the auxiliary capacitance line driver to obtain the same advantage. The number of auxiliary capacitance lines is determined by interconnection resistance calculated based on a material of the auxiliary capacitance lines, for example.

A display device according to the present invention may include a plurality of pixels each including a plurality of sub pixels, a plurality of auxiliary capacitance lines configured to form an auxiliary capacitance with the sub pixels, a plurality of third trunk lines, and an auxiliary capacitance line driver configured to supply an auxiliary capacitance drive signal to a plurality of second auxiliary capacitance line groups each including a predetermined number of auxiliary capacitance lines that are connected via each of the third trunk lines and to apply a voltage to the auxiliary capacitance. The auxiliary capacitance line driver may include a plurality of first connection terminals connected to each of the second auxiliary capacitance line groups. In such a display device, the predetermined number of auxiliary capacitance lines is two, for example.

In the display device, the second auxiliary capacitance line groups are separately connected to the auxiliary capacitance line driver such that the auxiliary capacitance drive signal is directly supplied from the auxiliary capacitance line driver to each of the second auxiliary capacitance line groups. Accordingly, the transmission delay and the transmission delay difference of the auxiliary capacitance drive signal are less likely to occur, thereby reducing the display defects. In addition, in the display device, the third trunk line is only required to transmit the auxiliary capacitance drive signal to the predetermined number of auxiliary capacitance lines. This enables the third trunk line to have a width smaller than the standard width determined depending on the predetermined number of auxiliary capacitance lines. In addition, this reduces the number of lines connecting the third trunk lines and the auxiliary capacitance line driver. Accordingly, the area of the frame section can be properly reduced.

The auxiliary capacitance line driver may be configured to output the auxiliary capacitance drive signal in an overshoot mode.

With this configuration of the display device, a charging time of the auxiliary capacitance can be shortened, thereby increasing the speed of the drive of the sub pixels. In addition, even if a supply period of the auxiliary capacitance drive signal to the auxiliary capacitance line is shortened, the advantage obtained by the application of the auxiliary capacitance drive signal, such as an expansion of a viewing angle, can be properly obtained.

Advantageous Effect of the Invention

According to the present invention, in the display device, the display defects are less likely to occur and the area of the frame section is reduced.

MODE FOR CARRYING OUT THE INVENTION

<First Embodiment>

A first embodiment of the present invention will be described with reference to the drawings.

1. Configuration of a Display Device

Figure 1:
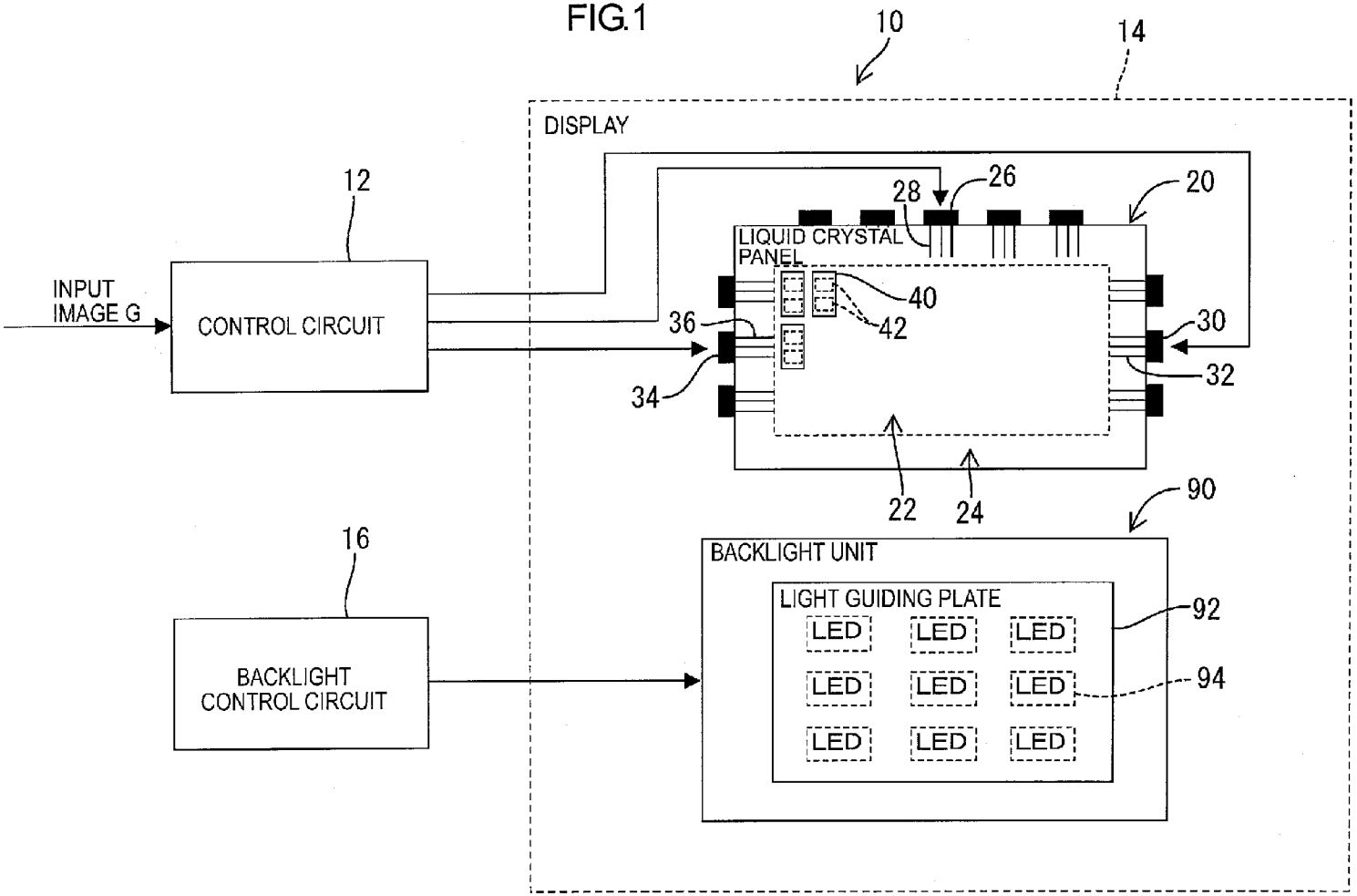
FIG. 1 is a view illustrating a configuration of a display device 10 according to a first embodiment.

As illustrated in FIG. 1, a display device 10 includes a control circuit 12, a display section 14, and a backlight control circuit 16. The display section 14 includes a liquid crystal panel 20 and a backlight unit 90.

The control circuit 12 is configured to drive the liquid crystal panel 20 based on an input image G supplied from an external device (not illustrated). The backlight control circuit 16 is configured to drive the backlight unit 90. The backlight control unit 16 may be configured to drive the backlight unit 90 in conjunction with the control circuit 12 or to drive the backlight unit 90 independently from the control circuit 12.

The liquid crystal panel 20 includes a display section 22 and a frame section 24 around the display section 22. In the display section 22, a plurality of pixels 40 are provided. On an outer surface of the liquid crystal panel 20, source drivers 26, gate drivers 30 (an example of a scanning line driver), and auxiliary capacitance drivers 34 (an example of an auxiliary capacitance driver) are COF (chip on film) mounted. The source drivers 26 are each configured to apply a display signal to a corresponding signal line 28. The gate drivers 30 are each configured to apply a scanning line drive signal (a scanning line signal) to a corresponding scanning line 32. The auxiliary capacitance drivers 34 are each configured to apply an auxiliary capacitance drive signal to a corresponding auxiliary capacitance line 36. The signal lines 28, the scanning lines 32, and the auxiliary capacitance lines 36 are connected to output terminals of the driver 26, 30, 24 corresponding thereto. The lines 28, 32, 36 extend to the display section 22 through the frame section 24 and are connected to each of the pixels 40.

Figure 2:
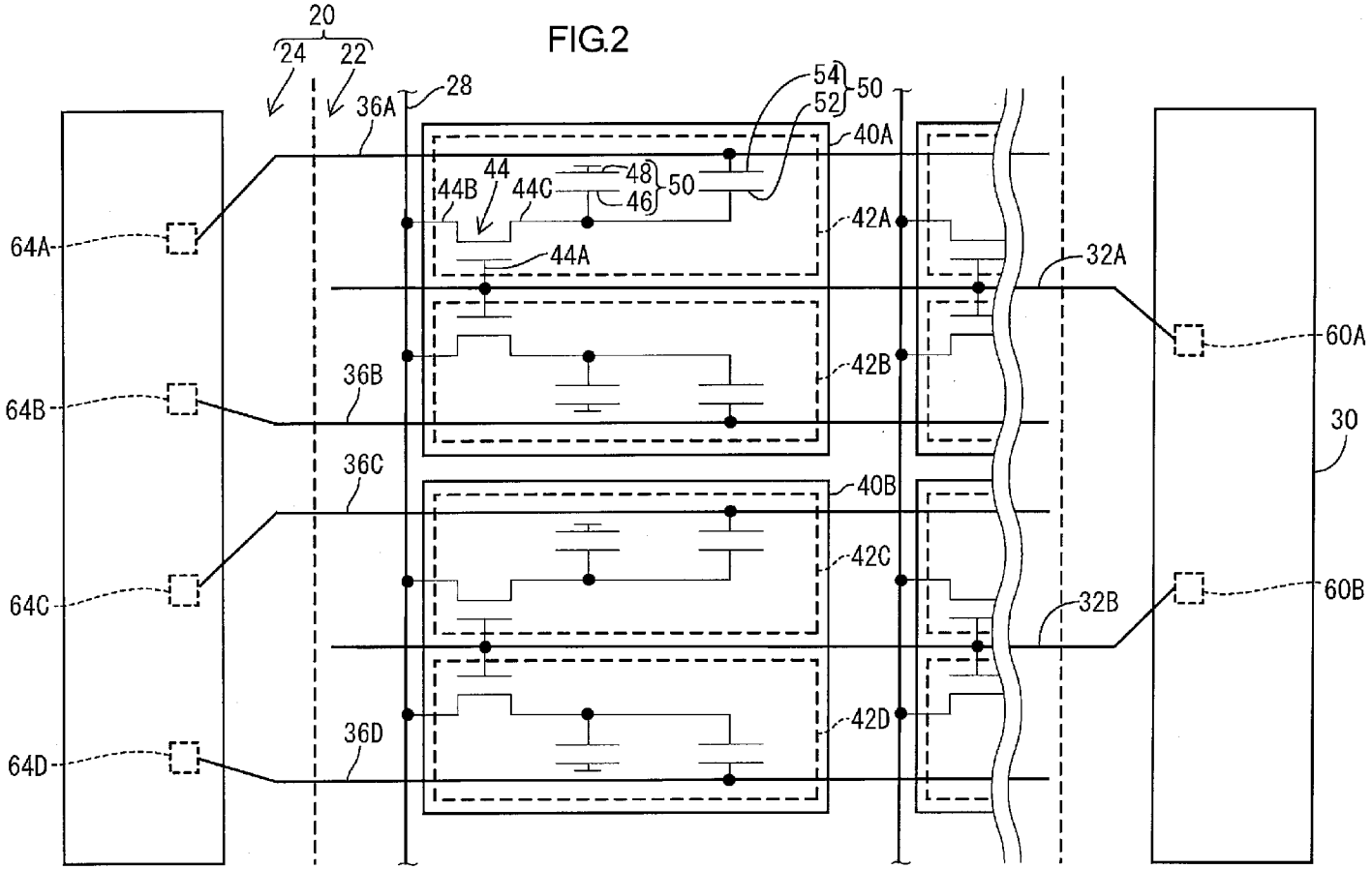
FIG. 2 is a view illustrating an equivalent circuit of a pixel 40.

FIG. 2 illustrates an equivalent circuit of the pixel 40. In the display section 22, the scanning lines 32 and the auxiliary capacitance lines 36 extend in a right-left direction of the sheet (hereinafter, referred to as a first direction) and the signal lines 28 extend in an upper-lower direction of the sheet (hereinafter, referred to as a second direction). The pixels 40 are arranged along the lines 28, 32, 36. Each of the pixels 40 includes two sub pixels 42. Each of the sub pixels 42 includes a switching device 44, the pixel electrode 46, and the capacitance electrode 52. The switching device 44 includes a switching electrode 44A and data electrodes 44B, 44C. The switching electrode 44A is connected to a corresponding one of the scanning lines 32. The data electrode 44B is connected to a corresponding one of the signal lines 28. The date electrode 44C is connected to the pixel electrode 46 and the capacitance electrode 52.

The pixel electrode 46 is arranged to face a counter electrode 48 via the liquid crystal molecules sealed in the liquid crystal panel 20. The pixel electrode 46 and the counter electrode 48 form the pixel capacitance 50 therebetween. The capacitance electrode 52 is arranged to face a counter electrode 54 connected to a corresponding auxiliary capacitance line 36. An auxiliary capacitance 56 is formed between the capacitance electrode 52 and the counter electrode 54. In the sub pixel 42, the pixel capacitance 50 and the auxiliary capacitance 56 are connected in parallel. The voltage applied to the liquid crystal molecules in an area opposing to the pixel electrode 46 in each pixel 42 is varied according to a display signal applied to the pixel electrode 46 (the capacitance electrode 52) through the switching device 44, a counter electrode potential Vcom applied to the counter electrode 48, or the auxiliary capacitance signal applied to the counter electrode 54. An alignment of the liquid crystal molecules are changed according to the auxiliary capacitance signal, and thus the light transmission rate and the viewing angle of the pixel 40 (the sub pixel 42) are changed.

The pixels 40A, 40B are connected to the same signal line 28 and connected to the respective scanning line 32A, 32B. The scanning line 32A is connected to the switching devices 44 each included in each of the sub pixels 42A, 42B of the pixel 40A and is connected to an output terminal 60A of the gate driver 30. The scanning line 32B is connected to the switching devices 44 each included in each of the sub pixels 42C, 42D of the pixel 40B and is connected to an output terminal 60B of the gate driver 30. The scanning lines 32A, 32B are connected to the respective output terminals 60A, 60B.

The sub pixels 42A to 42D are connected to the respective auxiliary capacitance lines 36A to 36D. The auxiliary capacitance line 36A is connected to the counter electrode 54 of the sub pixel 42A and connected to an output terminal 64A of the auxiliary capacitance driver 34. The auxiliary capacitance line 36B is connected to the counter electrode 54 of the sub pixel 42B and connected to the output terminal 64B of the auxiliary capacitance driver 34. That is, each of the sub pixels 42A, 42B included in one pixel 40A independently forms the auxiliary capacitance 56 with each of the auxiliary capacitance lines 36A, 36B. The auxiliary capacitance lines 36A, 36B are connected to the respective output terminals 64 of the auxiliary capacitance driver 34. The sub pixels 42C, 42D included in the pixel 40B have the same configuration as above and the detailed description thereof will not be described.

The backlight unit 90 is arranged behind the liquid crystal panel 20. The backlight unit 90 includes a diffuser plate 92 and LEDs 94 (Light Emitting Diode) as light sources. The LEDs 94 are arranged to face a rear surface of the diffuser plate 92. The diffuser plate 92 has a main surface facing the liquid crystal panel 20. Light from the LEDs 94 enters the diffuser plate 92 from its rear surface and passes therethrough while being diffused. The diffused light exits through the main surface of the diffuser plate 92 facing the liquid crystal panel 20 and is applied to the liquid crystal panel 20. The backlight unit 90 is a direct-type backlight unit in which the LEDs 64 are arranged on a rear section in a thickness direction thereof and the diffuser plate 62 is arranged in front of the LEDs 94.

2. Control of the Display Device

The control circuit 12 controls the gate driver 30 to output the scanning line signal to the scanning line 32 and controls the source driver 26 to output the display signal to the signal line 28, while driving the liquid crystal panel 20 of the display section 14. In each pixel 40, the display signal inputted to the switching device 44 that is turned on by the input of the scanning line signal is inputted into the pixel electrode 46 and the capacitance electrode 52 through the switching device 44. Further, the control circuit 12 controls the auxiliary capacitance driver 34 to output the auxiliary capacitance signal to the auxiliary capacitance line 36 in synchronization with the output of the scanning line signal. Then, the auxiliary capacitance signal is input to the counter electrode 54. In the sub pixel 42, the voltage to be applied to the liquid crystal molecules is determined based on the display signal, the auxiliary capacitance signal, and a capacitance ratio between the pixel capacitance 50 and the auxiliary capacitance 56, for example, to change the alignment of the liquid crystal molecules. Accordingly, the pixel 40 is controlled to have a desired light transmission rate.

Figure 3:
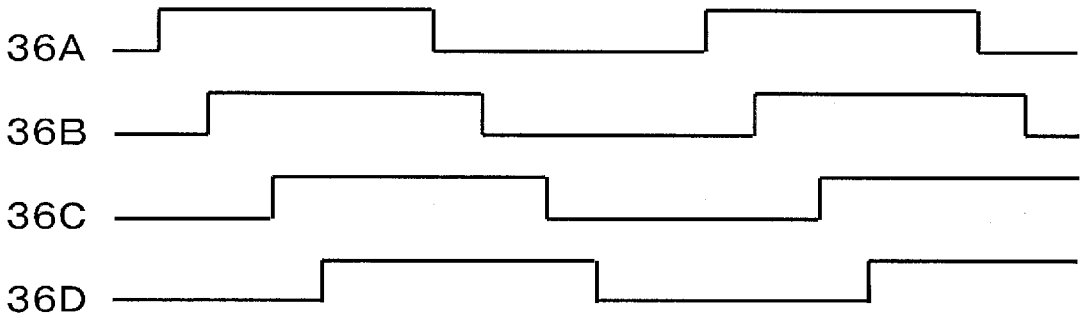
FIG. 3 is a graph indicating auxiliary capacitance signals.

As illustrated in FIG. 3, the control circuit 12 is configured to cause the auxiliary capacitance driver 34 to output a different auxiliary capacitance signal to each of the auxiliary capacitance lines 36. With this configuration, a different voltage is applied to the liquid crystal molecules in each of the sub pixels 42 included in one pixel 40. Thus, each of the sub pixels 42 is set to have a different viewing angle, and the pixel 40 as a whole can be set to have a desired viewing angle.

3. Effects of the First Embodiment (1) In the display device 10 of this embodiment, the auxiliary capacitance lines 36 are independently connected to the auxiliary capacitance driver 34, and the auxiliary capacitance signal is directly supplied to each of the auxiliary capacitance lines 36 from the auxiliary capacitance driver 34. This reduces the delay in transmission of the auxiliary capacitance signal and the transmission delay difference, thereby reducing the display defects. Further, in the display device 10 of this embodiment, a trunk line that transmits the auxiliary capacitance signal between the auxiliary capacitance lines is not required to be provided in the frame section 24. This can reduce the area of the frame section 24.

(2) In the display device 20 of this embodiment, the auxiliary capacitance 56 in each sub pixel 42 included in each of the pixels 40 can be separately controlled. This can provide an advantage in displaying. For example, the viewing angle can be wider due to the improvement in the dependence of the gamma characteristics on the visual perception.

<Second Embodiment>

Figure 4:
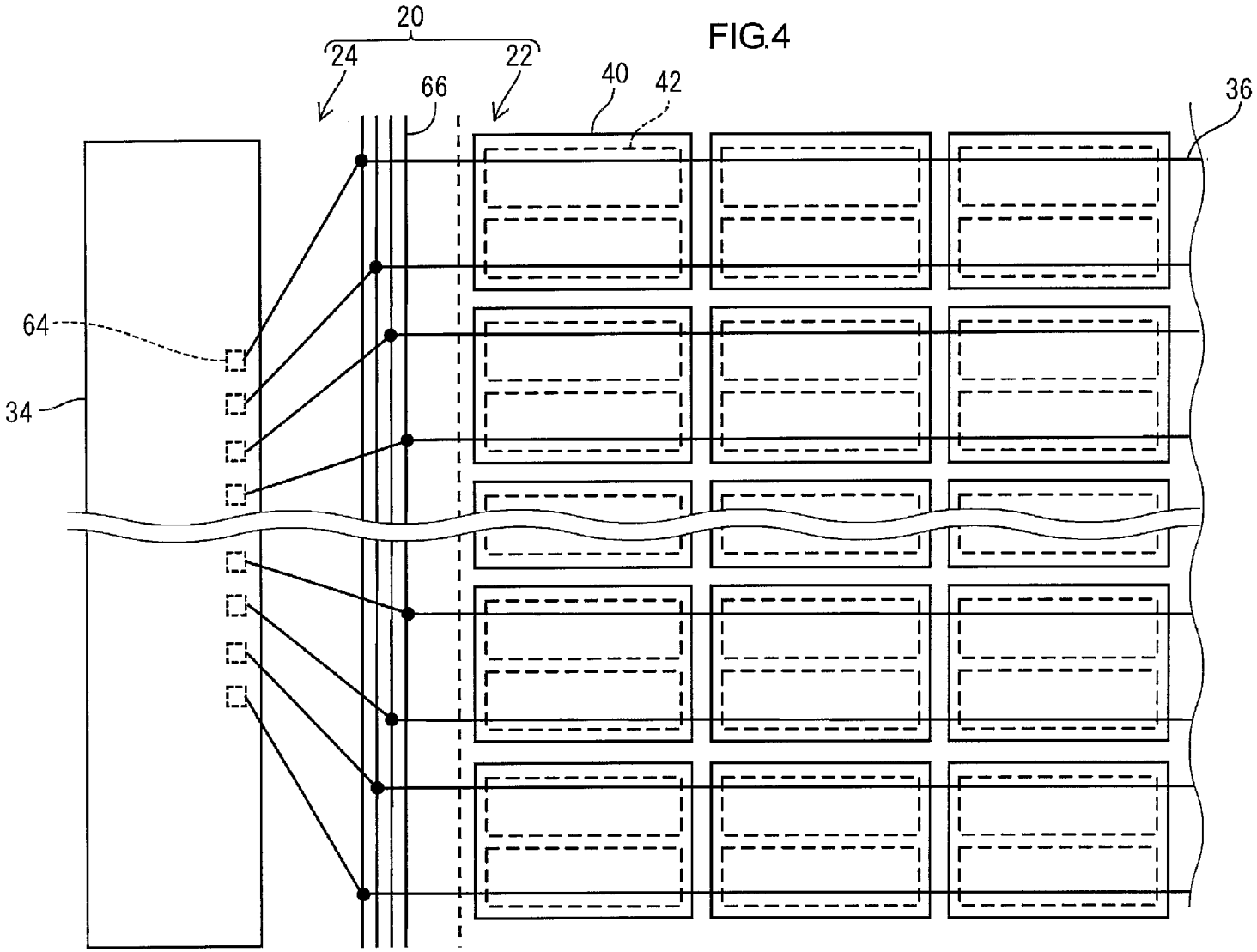
FIG. 4 is view illustrating a configuration of a liquid crystal panel 20 according to a second embodiment.

A second embodiment is described with reference to FIG. 4. As illustrated in FIG. 4, in a display device 10 of this embodiment, a trunk line 66 is provided on the frame section 24 of a liquid crystal panel 20. The display device 10 of this embodiment is different from the display device 10 of the first embodiment.

If each pixel 40 can have a predetermined light transmission rate and a predetermined viewing angle, the auxiliary capacitance signal applied to each of the auxiliary capacitance lines 36 may not be all varied. For example, the same kind of the auxiliary capacitance signal may be applied to a group of a predetermined number of auxiliary capacitance lines 36. This simplifies the configuration of the auxiliary capacitance driver 34 that generates the auxiliary capacitance signal.

As illustrated in FIG. 4, in this embodiment, the auxiliary capacitance lines 36 to which the same auxiliary capacitance signal is applied are connected via the trunk line 66 (an example of a first trunk line). Accordingly, the same auxiliary capacitance signals synchronized with each other are outputted from the auxiliary capacitance driver 34.

1. Effects of the Second Embodiment (1) According to the display device 10 of the present embodiment, the trunk line 66 enables the same auxiliary capacitance signals synchronized with each other to be outputted. This reduces the transmission difference of the auxiliary capacitance signal, thereby improving the display characteristics of the display device 10. The trunk line 66 is configured to synchronize the auxiliary capacitance drive signals and is not configured to transmit the auxiliary capacitance drive signals. Accordingly, compared with conventional trunk lines configured to transmit the auxiliary capacitance drive signal, the trunk line 66 can have a smaller size, thereby reducing the area of the frame section 24.

<Third Embodiment>

Figure 5:
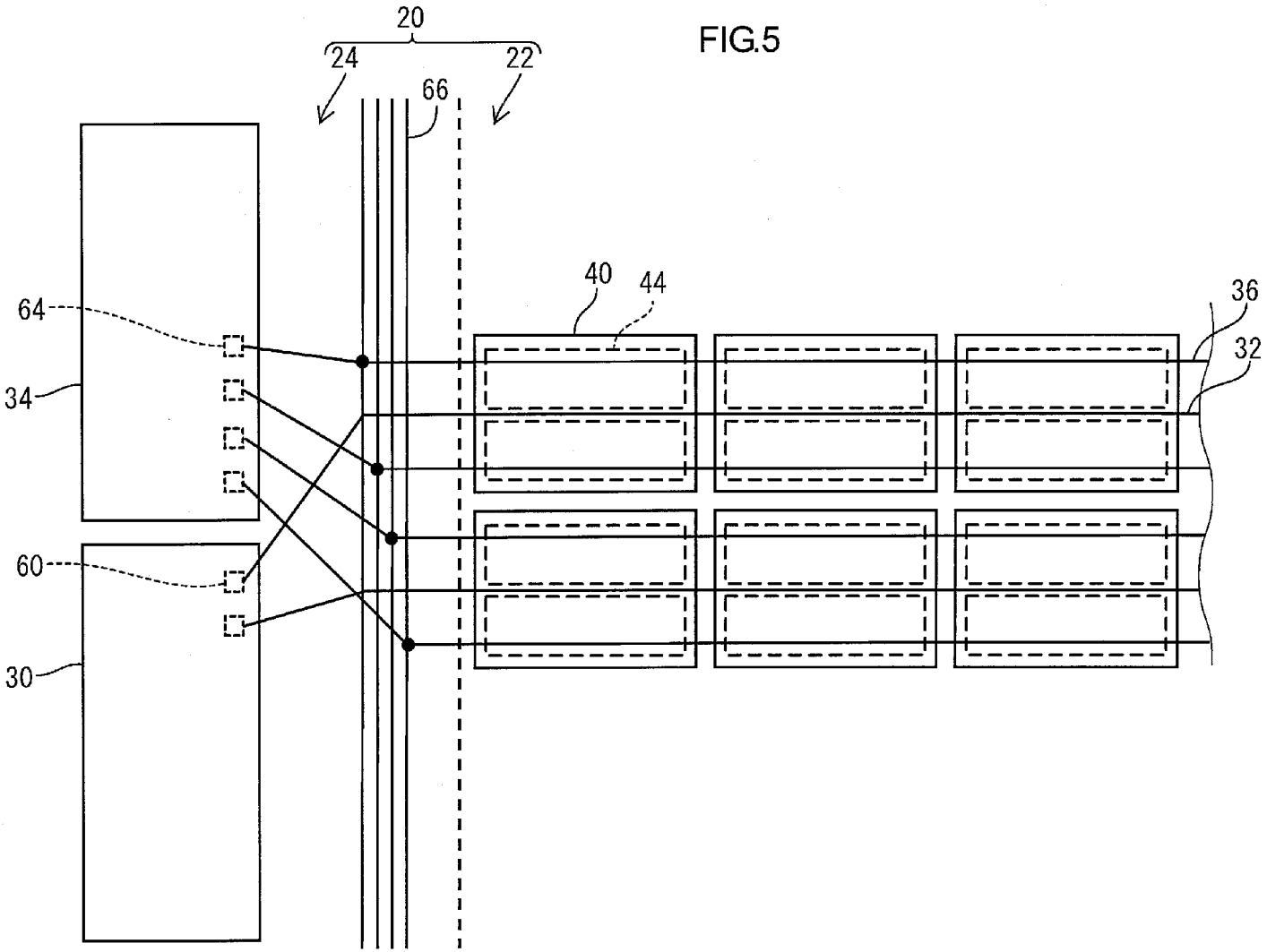
FIG. 5 is a view illustrating a configuration of the liquid crystal panel 20 according to a third embodiment.

A third embodiment is described with reference to FIG. 5. As illustrated in FIG. 5, in a display device 10 of this embodiment, the gate driver 30 and the auxiliary capacitance driver 34 are arranged on one side in the first direction of the display section 22 of the liquid crystal panel 20. The display device 10 of the third embodiment is different from the display device 10 of the second embodiment.

1. Effects of the Third Embodiment (1) In the display device 10 of this embodiment, the gate driver 30 to which the scanning line 32 is connected and the auxiliary capacitance driver 34 to which the auxiliary capacitance line 36 is connected can be arranged in the same frame section 24. Accordingly, the area of the frame section 24 can be reduced.

<Fourth Embodiment>

Figure 6:
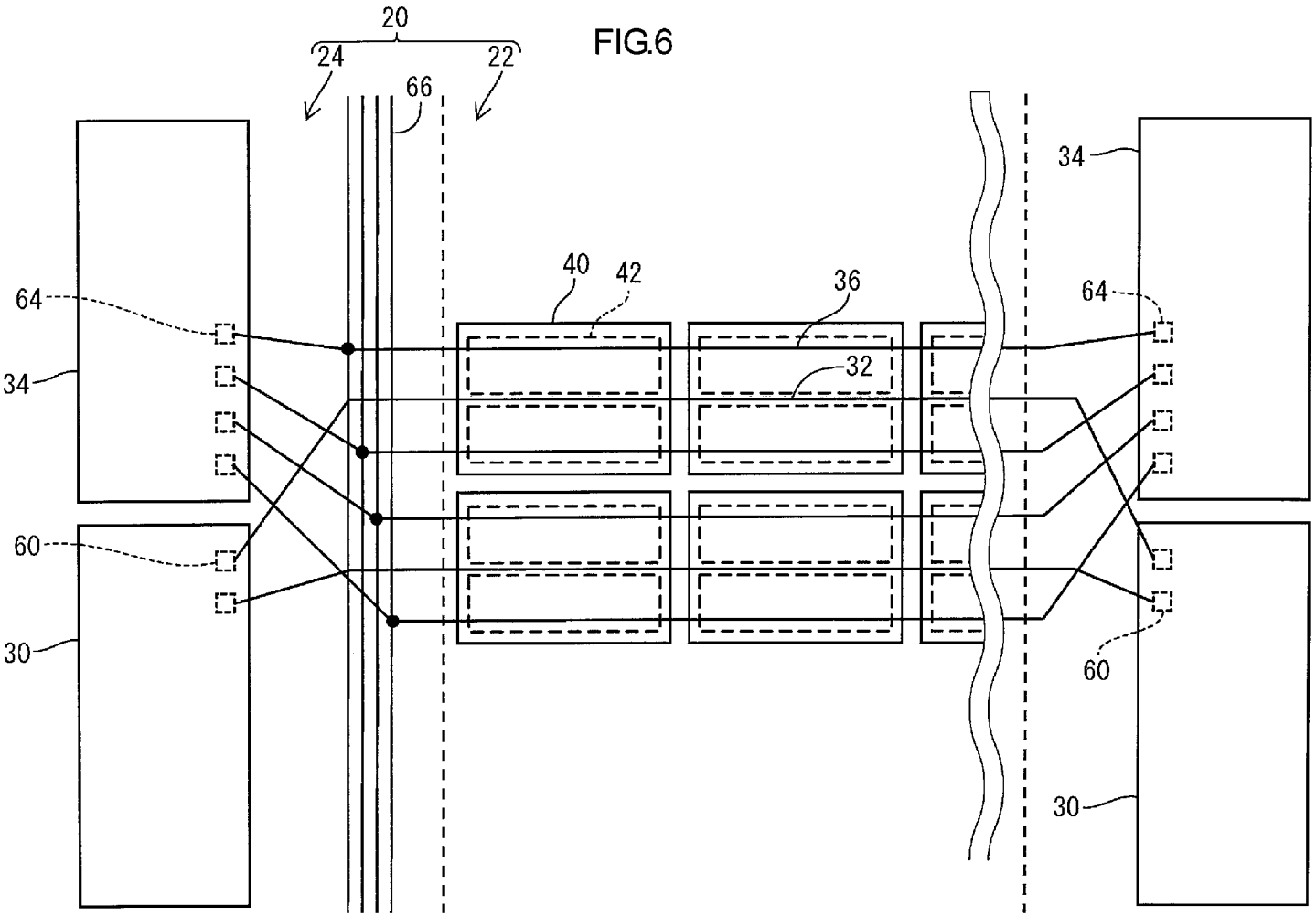
FIG. 6 is a view illustrating a configuration of the liquid crystal panel 20 according to a fourth embodiment.

A fourth embodiment is described with reference to FIG. 6. As illustrated in FIG. 6, in a display device 10 of this embodiment, the gate driver 30 and the auxiliary capacitance driver 34 are arranged on one side in the first direction of the display section 22 of the liquid crystal panel 20. The display device 10 of the fourth embodiment is different from the display device 10 of the third embodiment.

1. Effects of the Fourth Embodiment (1) In the display device 10 of this embodiment, the drive signal can be applied to the auxiliary capacitance line 36 and the scanning line 32 from both sides, thereby reducing the transmission delay of the drive signal.

<Fifth Embodiment>

Figure 7:
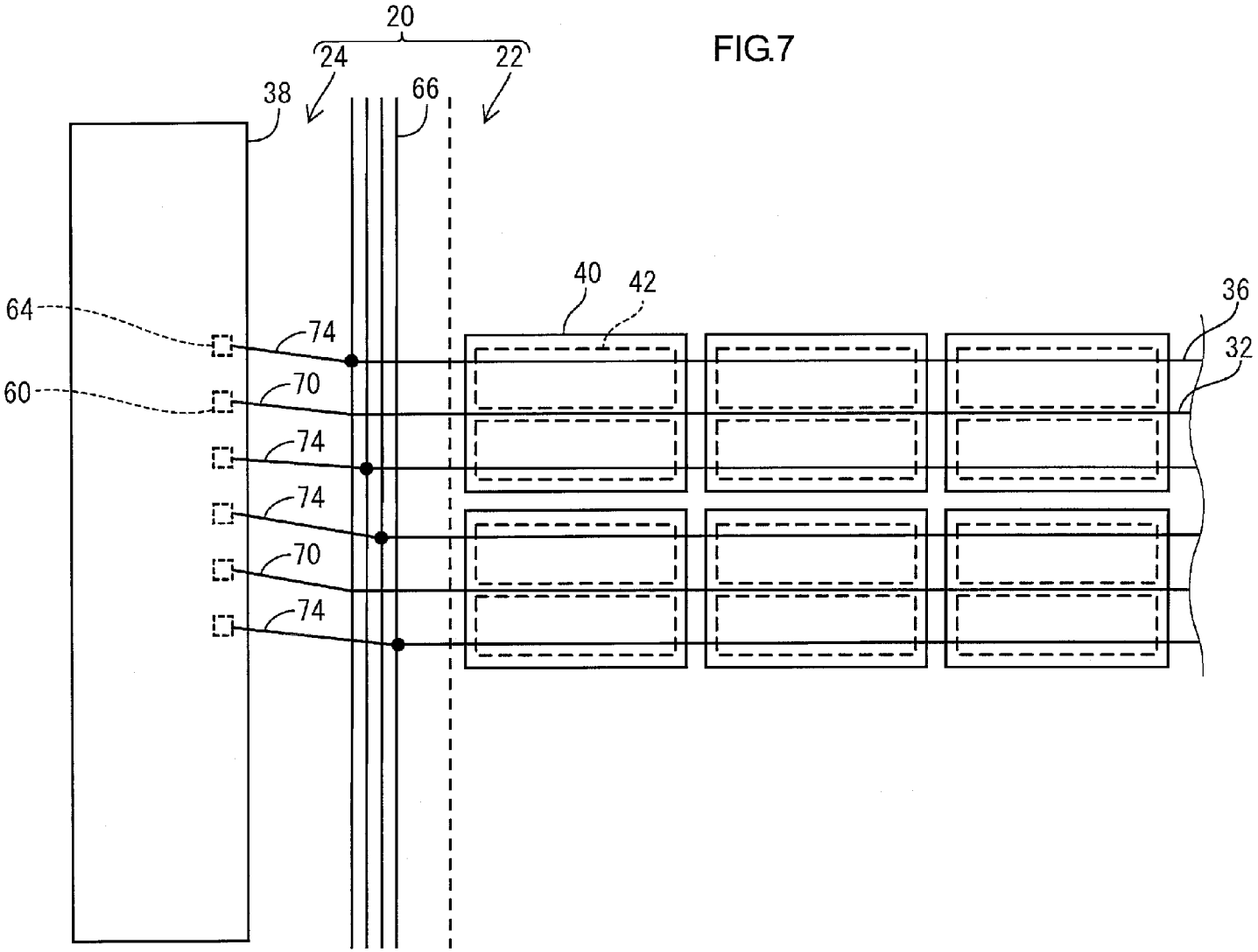
FIG. 7 is a view illustrating a configuration of the liquid crystal panel 20 according to a fifth embodiment.

A fifth embodiment is described with reference to FIG. 7. As illustrated in FIG. 7, in a display device 10 of this embodiment, instead of the gate driver 30 and the auxiliary capacitance driver 34, a pixel driver 38 (a pixel driver) that functions as the drivers 30, 34 is mounted in a section outside the liquid crystal panel 20. The display device 10 of the fifth embodiment is different from the display device 10 of the third embodiment. The pixel driver 38 may be located adjacent to one side of the display section 22 of the liquid crystal panel 20 in the first direction or may be located adjacent to both sides of the display section 22 in the first direction.

1. Configuration of the Display Device

The pixel driver 38 that functions as the gate driver 30 and the auxiliary capacitance driver 34 includes the output terminals 60 for applying the scanning line signal to the scanning lines 32 and the output terminals 64 for applying the auxiliary capacitance signals to the auxiliary capacitance line 36. The output terminals 60, 64 are arranged along the second direction. The output terminals 60, 64 are arranged in the order corresponding to the scanning lines 32 and the auxiliary capacitance lines 36 that are arranged in the second direction in the liquid crystal panel 20 to which the pixel driver 38 is mounted.

2. Effects of the Fifth Embodiment (1) In the display device 10 of the this embodiment, the lines for the signals such as power potential that are supplied from the control circuit 12 to the gate driver 30 or the auxiliary capacitance driver 34 can be shared. Accordingly, the area of the frame section 24 in which the lines are arranged can be reduced.

(2) In the display device 10 of the this embodiment, a line 70 connecting the output terminal 60 and the scanning line 32 and a line 74 connecting the output terminal 64 and the auxiliary capacitance line 36 are hardly overlapped with each other. Accordingly, each line 70, 74 can be shortened, thereby reducing the area of the frame section 24. In addition, signal potential fluctuation that may be caused by the lines 70, 74 overlapped with each other hardly occurs, thereby improving the display characteristics.

<Sixth Embodiment>

Figure 8:
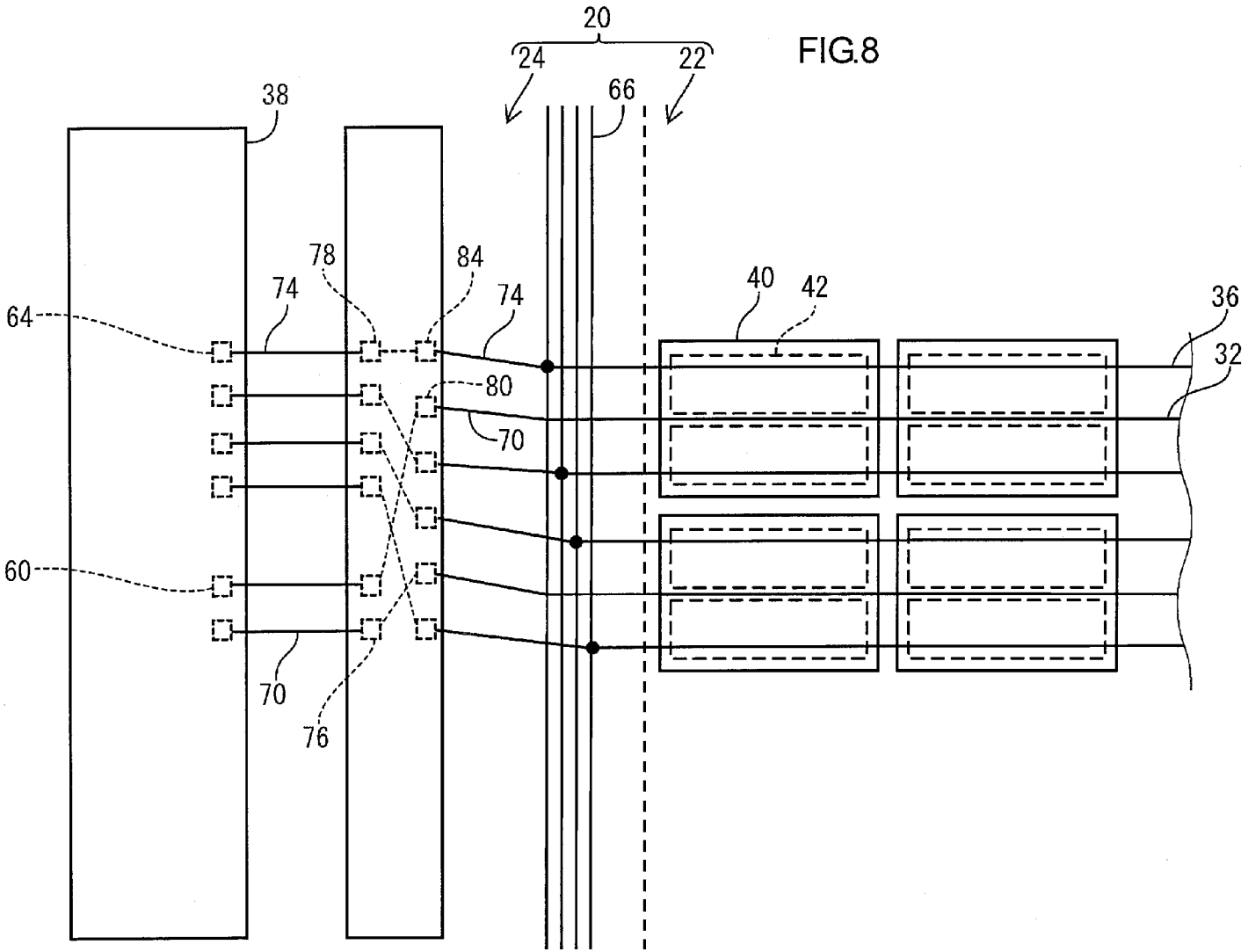
FIG. 8 is view illustrating a configuration of the liquid crystal panel 20 according to a sixth embodiment.

A sixth embodiment is described with reference to FIG. 8. As illustrated in FIG. 8, in a display device 10 of this embodiment, a connection chip 82 (an example of a connection device) is COG (chip on glass) mounted between the pixel driver 38 and the display section 22. The display device 10 of the sixth embodiment is different from the display device 10 of the fifth embodiment.

1. Configuration of the Display Device

In the pixel driver 38 that is mounted to the liquid crystal panel 20, like the fifth embodiment, it is preferable that the output terminals 60 and the output terminals 64 are arranged in the second direction in the order corresponding to the order of the scanning lines 32 and the auxiliary capacitance lines 36 arranged in the liquid crystal panel 20 in the second direction. However, the output terminals 60 and the output terminals 64 cannot be arranged as above in some cases to reduce the area of the driver. For example, FIG. 8 illustrates an arrangement in which the output terminals 60 are arranged at one side (an upper side) in the second direction and the output terminals 64 are arranged at the other side (a lower side) in the second direction. In such an arrangement, the lines are still required not to be overlapped with each other to reduce the area of the frame section 24 and to improve the display characteristics.

As illustrated in FIG. 8, according to this embodiment, the connection chip 82 is arranged between the pixel driver 38 and the display section 22. Via the connection chip 82, the output terminal 60 is connected to the scanning line 32 and the output terminal 64 is connected to the auxiliary capacitance line 36. The connection chip 82 includes input terminals 76, 78 and output terminals 80, 84.

The input terminals 76, 78 are arranged at a side closer to the pixel driver 38 with the connection chip 82 being mounted to the liquid crystal panel 20. The input terminals 76 are connected to the output terminals 60 of the pixel driver 38 via the lines 70. The input terminals 78 are connected to the output terminals 64 of the pixel driver 38 via the lines 74. The input terminals 76, 78 are arranged in the second direction in the order corresponding to the order of the output terminals 60, 64 arranged in the second direction. Accordingly, in the liquid crystal panel 20 of this embodiment, the lines 70, 74 are hardly overlapped with each other between the pixel driver 38 and the connection chip 82.

The output terminals 80, 84 are arranged at a side closer to the display section 22 with the connection chip 82 being mounted to the liquid crystal panel 20. The output terminals 80 are connected to the scanning lines 32 via the lines 70. The output terminals 80 are connected to the auxiliary capacitance lines 36 via the lines 74. The output terminals 80, 84 are arranged in the second direction in the order corresponding to the order of the scanning lines 32 and the auxiliary capacitance lines 36 arranged in the second direction. Accordingly, in the liquid crystal panel 20 of this embodiment, the lines 70, 74 are hardly overlapped with each other between the connection chip 82 and the display section 22.

2. Effects of the Sixth Embodiment (1) The display device 10 of this embodiment includes the connection chip 82 including the input terminals 78, 80 arranged to correspond to the output terminals 60, 64 of the pixel driver 38 and the output terminals 84, 80 arranged to correspond to the scanning lines 32 and the auxiliary capacitance lines 36. Accordingly, the lines 70, 74 are hardly overlapped with each other due to the connection chip 82, and thus, compared with the display device without the connection chip 82, the frame section 24 can have a small size and the display characteristics can be improved.

<Seventh Embodiment>

Figure 9:
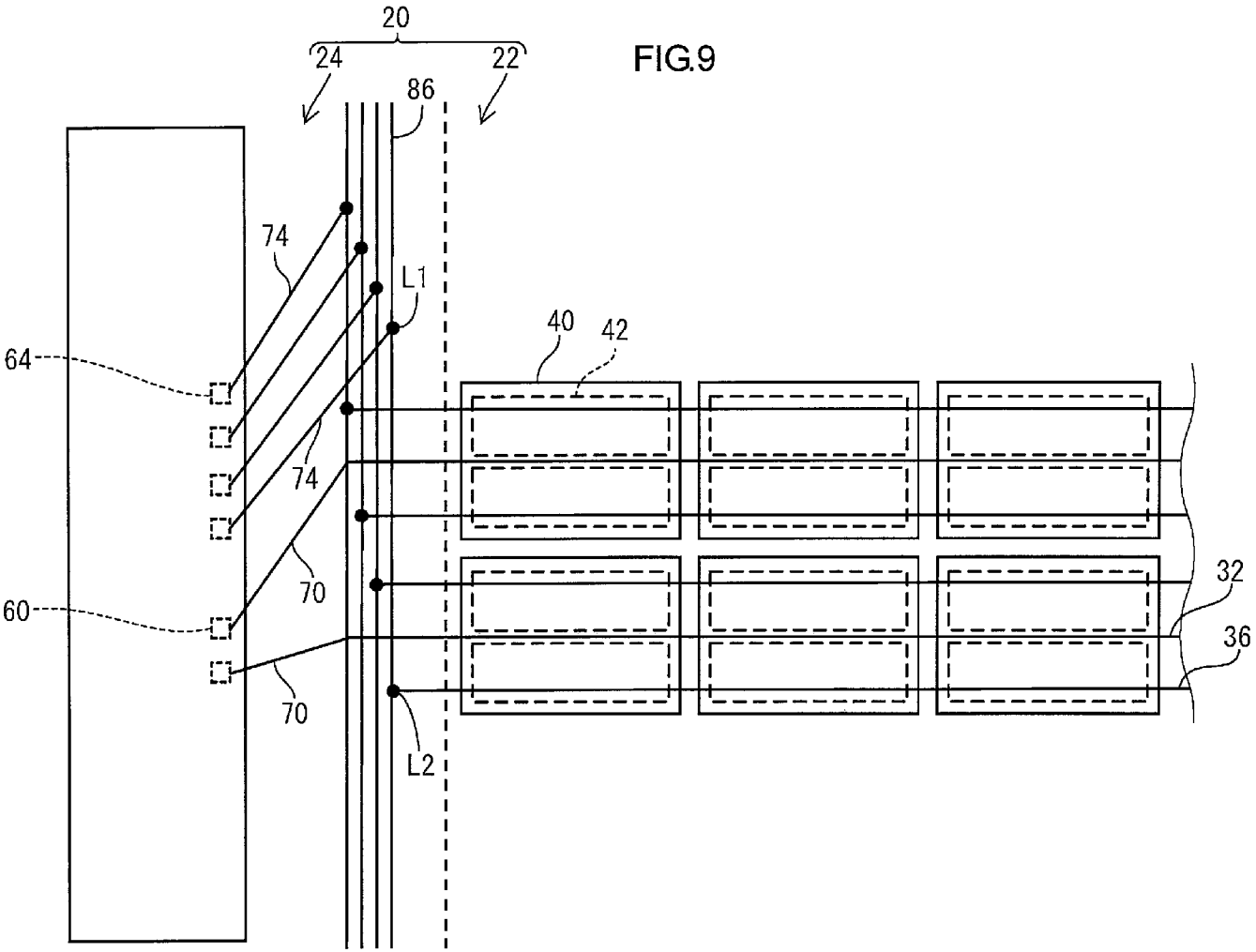
FIG. 9 is a view illustrating a configuration of the liquid crystal panel 20 according to a seventh embodiment.

A seventh embodiment is described with reference to FIG. 9. As illustrated in FIG. 9, in a display device 10 of this embodiment, the output terminals 64 and the auxiliary capacitance lines 36 are connected via trunk lines 86 (an example of a second trunk line) instead of the connection chip 82. The display device 10 of the seventh embodiment is different from the display device 10 of the sixth embodiment. In this embodiment, the output terminals 60 and the scanning lines 32 are directly connected via the lines 70.

1. Configuration of the Display Device

The trunk lines 86 are each connected to the line 74, which is connected to the output terminal 64 of the pixel driver 38, at a first position L1 of the trunk line 86 and each connected to the auxiliary capacitance line 36 at a second position L2 thereof. In this embodiment, the scanning lines 32 are directly connected to the output terminals 60 via the lines 70 with the lines 70, 74 being not overlapped with each other. In this configuration, as illustrated in FIG. 9, depending on the arrangement order of the output terminals 60, 64 in the second direction, the first positions L1 and the second positions L2 may be located at different sides with respect to the lines 70 and the scanning lines 32 in the second direction. That is, the first position L1 maybe located at positions different from the second position L2 in the trunk line 88.

In such a case, according to this embodiment, the auxiliary capacitance signal is transmitted between the first position L1 and the second position L2 via the trunk line 86. The trunk line 86 of this embodiment that is configured to transmit the auxiliary capacitance signal in the second direction is different from the trunk line 66 of the second embodiment that is configured to synchronize the auxiliary capacitance signals. In the display device 10 of this embodiment, each of the output terminals 64 corresponds to each of the auxiliary capacitance lines 36 like the display device 10 of the first to sixth embodiments.

2. Effects of the Seventh Embodiment (1) In the display device 10 of this embodiment, the first position L1 and the second position L2 are located at different positions in the trunk line 88, such that the lines 70, 74 are hardly overlapped with each other even when the output lines 60 and the scanning lines 32 are directly connected with each other. Accordingly, the area of the frame section 24 can be reduced and the display characteristics can be improved.

(2) In the display device 10 of the this embodiment, the auxiliary capacitance signal is required to be transmitted in the second direction through the trunk line 86, so that the trunk line 86 has a larger width than the trunk line 66 of the second embodiment. However, each of the output terminals 64 corresponds to each of the auxiliary capacitance lines 36, so that the trunk line 86 is not required to pass the auxiliary capacitance signal transmitted from one output terminal 64 to the plurality of auxiliary capacitance lines 36. Accordingly, compared with the conventional trunk line configured to pass the auxiliary capacitance signal from one output terminal to the plurality of auxiliary capacitance lines 36, the trunk line 86 can have a small size and the area of the frame section 24 can be reduced.

<Eighth Embodiment>

Figure 10:
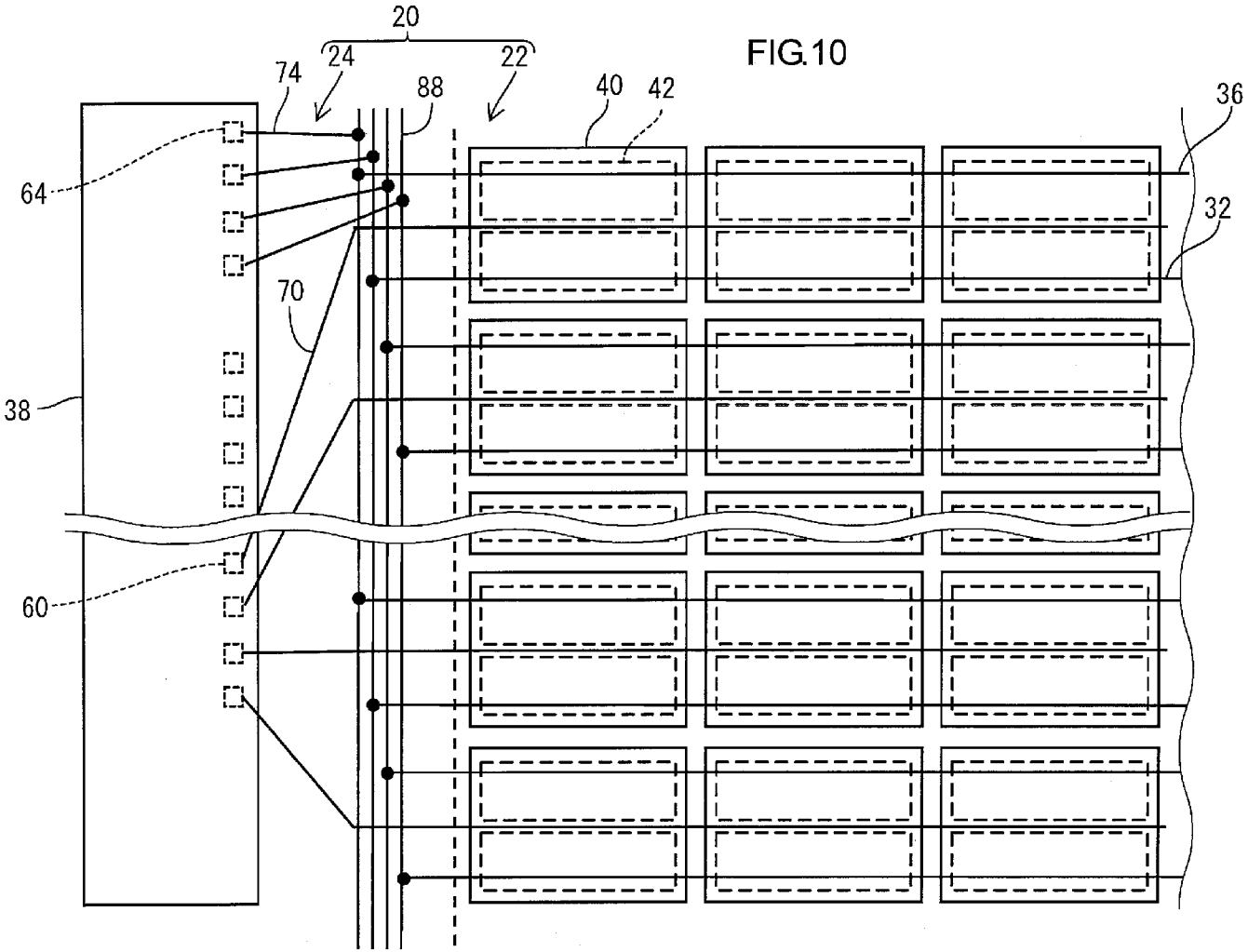
FIG. 10 is a view illustrating a configuration of the liquid crystal panel 20 according to an eighth embodiment.

A eighth embodiment is described with reference to FIG. 10. As illustrated in FIG. 10, in a display device 10 of this embodiment, one output terminal 64 corresponds to two auxiliary capacitance lines 36 in the liquid crystal panel 20. The display device 10 of this embodiment is different from the display device 10 of the seventh embodiment.

1. Configuration of the Display Device

In the display device 10, the auxiliary capacitance lines 36 are independently connected to the pixel driver 38, and thus the transmission delay of the auxiliary capacitance signal and the transmission delay difference hardly occur. However, the reduction in the transmission delay of the auxiliary capacitance signal and the transmission delay difference depends on the interconnection resistance of the auxiliary capacitance lines 36 or a potential level of the auxiliary capacitance signal, for example. The transmission delay of the auxiliary capacitance signal and the transmission delay difference may be reduced when each of the output terminals 64 corresponds to not only each one of the auxiliary capacitance line 36, but also to N number (N=2, 3 . . . ) of auxiliary capacitance lines 36.

In this embodiment, a predetermined number N (in this embodiment N=2) of the auxiliary capacitance lines 36 is determined in advance based on the interconnection resistance of the auxiliary capacitance lines 26 and the potential level of the auxiliary capacitance signal such that the transmission delay of the auxiliary capacitance signal and the transmission delay difference hardly occur. The auxiliary capacitance signal is applied from one output terminal 64 to the predetermined number N of auxiliary capacitance lines 36.

The transmission delay of the auxiliary capacitance signal and the transmission delay difference can also be reduced even if the auxiliary capacitance signal is applied from one output terminal 64 to a fewer number of auxiliary capacitance lines 36 than the standard number N. However, with the configuration in which the auxiliary capacitance signal is applied from one output terminal 64 to the standard number N of auxiliary capacitance lines 36, the number of the lines 74 connecting the output terminals 64 and the auxiliary capacitance lines 36 can be reduced, thereby reducing the area of the frame section 24.

The standard number N of auxiliary capacitance lines 36 to which the auxiliary capacitance signal is applied from the same output terminal 64 are connected to each other through a trunk line 88 (an example of a third trunk line) and connected to the output line 64 through the line 74 connected to the trunk line 88. Accordingly, the trunk line 88 of this embodiment is configured to transmit the auxiliary capacitance signal in the second direction like the trunk line 86 of the seventh embodiment. However, the number of the auxiliary capacitance lines 36 configured to transmit the auxiliary capacitance signal is plural, and thus the trunk line 88 of this embodiment is different from the trunk line 86 of the seventh embodiment. The trunk line 88 is configured to transmit the auxiliary capacitance signal to the auxiliary capacitance line 36, and thus the width of the trunk line 88 increases compared with the trunk line 86 configured to transmit the auxiliary capacitance signal to one auxiliary capacitance line 36, thereby increasing the area of the frame section 24.

According to this embodiment, the trunk lines 86 are configured to only transmit the auxiliary capacitance drive signal to the predetermined number N of auxiliary capacitance lines 36 and have a width smaller than a standard width W that is determined depending on the predetermined number N of auxiliary capacitance lines 36. Accordingly, the width of the trunk line 86 is not increased, and thus the area of the frame section 24 is less likely to increase. In this embodiment, the area of the frame section 24 is less likely to be increased by the increase in the width of the trunk line 86. The area of the frame section 24 can be reduced as a whole by decreasing the number of the lines 74.

2. Effects of the Eighth Embodiment (1) In the display device 10 of this embodiment, the output terminal 64 of the pixel driver 38 is connected to the standard number N of auxiliary capacitance lines 36 that is determined based on the kind of liquid crystal panel 20, for example, and thus the auxiliary capacitance drive signal is directly supplied from the pixel driver 48 to the standard number N of auxiliary capacitance lines 36. The standard number N is determined such that the transmission delay of the auxiliary capacitance drive signal and the transmission delay difference are less likely to occur. Accordingly, even when the auxiliary capacitance signal is applied from one output terminal 64 to the auxiliary capacitance lines 36, the transmission delay of the auxiliary capacitance drive signal and the transmission delay difference are less likely to occur.

(2) In the display device 10 of this embodiment, the trunk line 88 is only required to transmit the auxiliary capacitance drive signal to the standard number N of auxiliary capacitance lines, and thus the width of the trunk line 86 is controlled to be smaller than the standard width W. Accordingly, the area of the frame section 24 can be reduced.

(3) In the display device 10 of this embodiment, the trunk line 86 having a predetermined width is required to be provided. However, the width of the trunk line 86 is controlled to be the predetermined width and the number of lines 74 connecting the output terminals 64 and the trunk lines 86 are reduced, thereby reducing the area of the frame section 24.

<Other Embodiments>

The present invention is not limited to the above embodiments described in the above description and the drawings. The following embodiments are also included in the technical scope of the present invention, for example.

Figure 11:
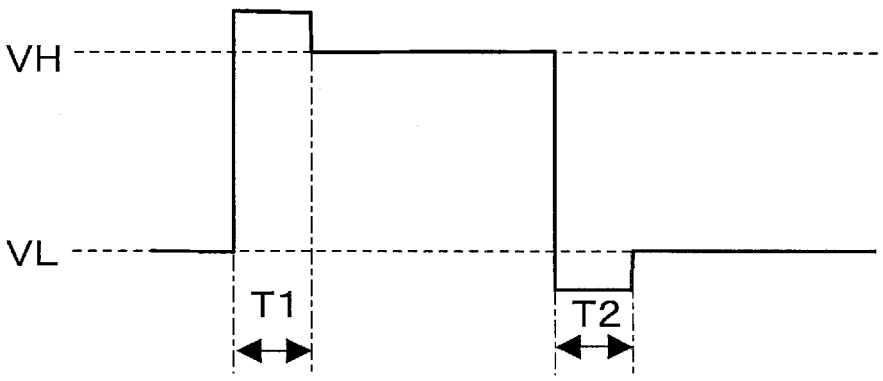
FIG. 11 is a graph indicating the auxiliary capacitance signals outputted in an overshoot mode.

(1) In the above embodiments, the auxiliary capacitance signal may be outputted in an overshoot mode. FIG. 11 illustrates a wave form of the auxiliary capacitance signal outputted in the overshoot mode.

In such an auxiliary capacitance signal, a voltage higher than a first target level VH by a few voltages is applied for a predetermined time T1 from a rising edge of the signal and a voltage lower than a second target level VL by a few voltages is applied for a predetermined time T2 from a falling edge of the signal. In other words, at the rising edge of the auxiliary capacitance drive signal, a potential higher than an intended potential is output for a brief moment, and then, the intended potential is output. Similarly, at the falling edge of the auxiliary capacitance drive signal, a potential lower than an intended potential is output for a brief moment, and then, the intended potential is output. This shortens a charging time of the auxiliary capacitance 56, thereby increasing the speed of the drive of the sub pixels 42. In addition, even if a supply period of the auxiliary capacitance drive signal to the auxiliary capacitance line 36 is shortened, the advantage obtained by the application of the auxiliary capacitance signal, such as an expansion of a viewing angle, can be properly obtained.

EXPLANATION OF SYMBOLS

10: display device, 12: control circuit, 14: display section, 16: backlight control circuit, 20: liquid crystal panel, 22: display section, 24: frame section, 26: source driver, 28: signal line, 30: gate driver, 32: scanning line, 34: auxiliary capacitance driver, 36: auxiliary capacitance line, 38: pixel driver, 40: pixel, 42: sub pixel, 46: pixel electrode, 50: pixel capacitance, 52: capacitance electrode, 56: auxiliary capacitance, 60, 64, 80, 84: output terminal, 66, 86, 88: trunk line, 76, 78: input terminal, 82: connection chip, 90: backlight unit, 92: diffuser plate, 92: LED, L1: first position, L2: second position, N: standard number, W: standard width

The invention claimed is:

1. A display device comprising:

a plurality of pixels each including a plurality of sub pixels;

a plurality of auxiliary capacitance lines configured to form an auxiliary capacitance with the sub pixels;

an auxiliary capacitance line driver configured to supply an auxiliary capacitance drive signal to the auxiliary capacitance lines and to apply a voltage to the auxiliary capacitance, the auxiliary capacitance line driver including a plurality of first connection terminals each connected to each of the auxiliary capacitance lines;

a plurality of scanning lines connected to the pixels; and a scanning line driver configured to supply a scanning line drive signal to the scanning lines to drive the pixels;

a connection device, a plurality of first connection lines, and a plurality of second connection lines, wherein the scanning lines and the auxiliary capacitance lines extend in a first direction;

the auxiliary capacitance line driver and the scanning line driver are located adjacent to a first end in the first direction of a section in which the pixels are arranged;

the auxiliary capacitance line driver and the scanning line driver are included in a pixel driver;

the scanning line driver includes a plurality of second connection terminals connected to the scanning lines;

the connection device includes a plurality of third connection terminals, fourth connection terminals, fifth connection terminals, and sixth connection terminals therein, the third connection terminals being connected to the first connection terminals via the first connection lines, the fourth connection terminals being connected to the second connection terminals via the second connection lines, the fifth connection terminals being connected to the third connection terminals and the auxiliary capacitance lines, and the sixth connection terminal being connected to the fourth connection terminals and the scanning lines;

the third connection terminals and the fourth connection terminals are arranged in a second direction different from the first direction so as to correspond to the first connection terminals and the second connection terminals, respectively, in the second direction; and the fifth connection terminals and the sixth connection terminals are arranged in the second direction so as to correspond to the auxiliary capacitance lines and the scanning lines, respectively, in the second direction.

* * * * *